United States Patent [19]

Williams et al.

[11] Patent Number: 4,484,421

[45] Date of Patent: Nov. 27, 1984

[54] TRAVELING STAGE

[76] Inventors: Richard B. Williams, 116 Lexington Ave., New York, N.Y. 10016; Thomas V. Janus, 300 Riverside Dr. #6C, New York, N.Y. 10025

[21] Appl. No.: 427,518

[22] Filed: Sep. 29, 1982

[51] Int. Cl.[3] ..... E04H 3/26

[52] U.S. Cl. ..... 52/7; 52/28; 52/125.2; 212/218

[58] Field of Search ..... 52/6, 7, 125.1, 125.2, 52/745, 40; 212/218

[56] References Cited

U.S. PATENT DOCUMENTS

| | | | |
|---|---|---|---|
| 3,417,518 | 12/1968 | Jaffe | 52/7 |
| 3,449,872 | 6/1969 | Craighead | 52/125.2 |

FOREIGN PATENT DOCUMENTS

| | | | |
|---|---|---|---|
| 92136 | 9/1922 | Austria | 52/7 |
| 361799 | 4/1921 | Fed. Rep. of Germany | 52/7 |
| 705784 | 5/1941 | Fed. Rep. of Germany | 212/13 |
| 861018 | 12/1952 | Fed. Rep. of Germany | 212/218 |
| 1084473 | 1/1955 | France | 212/218 |
| 56995 | 12/1920 | Sweden | 52/7 |

*Primary Examiner*—Henry E. Raduazo

[57] ABSTRACT

A stage capable of rapid assembly and disassembly is provided for a traveling show. Through the use of appropriate vertical columns, main trusses and I-beams, a support structure is formed for the stage. Appropriate lighting and curtain structures are then supported from the I-beams. Collapsible tables provide a stage area.

5 Claims, 4 Drawing Figures

TRAVELING STAGE

BACKGROUND OF THE INVENTION

1. Field of the Invention

The invention is directed to a traveling stage, and, more particularly, a stage structure which can be rapidly assembled and disassembled by a minimum number of individuals.

SUMMARY OF THE INVENTION

The traveling stage is composed of three spaced apart main truss members which are positioned in a parallel relationship. Vertical columns at the end of each truss raise the truss members from floor level to their upper support position. I-beams span the distance between the truss members and are fastened to the truss members. Lighting means for the stage are carried within the frame of the truss members and curtain support means with curtains are carried by the I-beams. A plurality of collapsible table-like structures are positioned under primarily the center and rear truss members to form a stage area raised above the floor of the building on which the stage is assembled.

The stage is made of lightweight metal structures that are bolted together to form long assemblies. All the parts are coordinated so that they can be rapidly assembled with a minimum of personnel.

DESCRIPTION OF THE PREFERRED EMBODIMENT

The traveling stage is composed first of three spaced apart trusses 2 which are positioned in a parallel relationship one with the other. They are also meant to be put in an operative position where they will be parallel with the flooring upon which the stage rests. Vertical columns 4 at the end of each truss support the trusses in position. The columns are provided with some type of enlarged base and they rest upon the flooring on which the stage is positioned. Each column is perpendicular to the flooring and is also perpendicular to the truss it supports.

Figure 1:
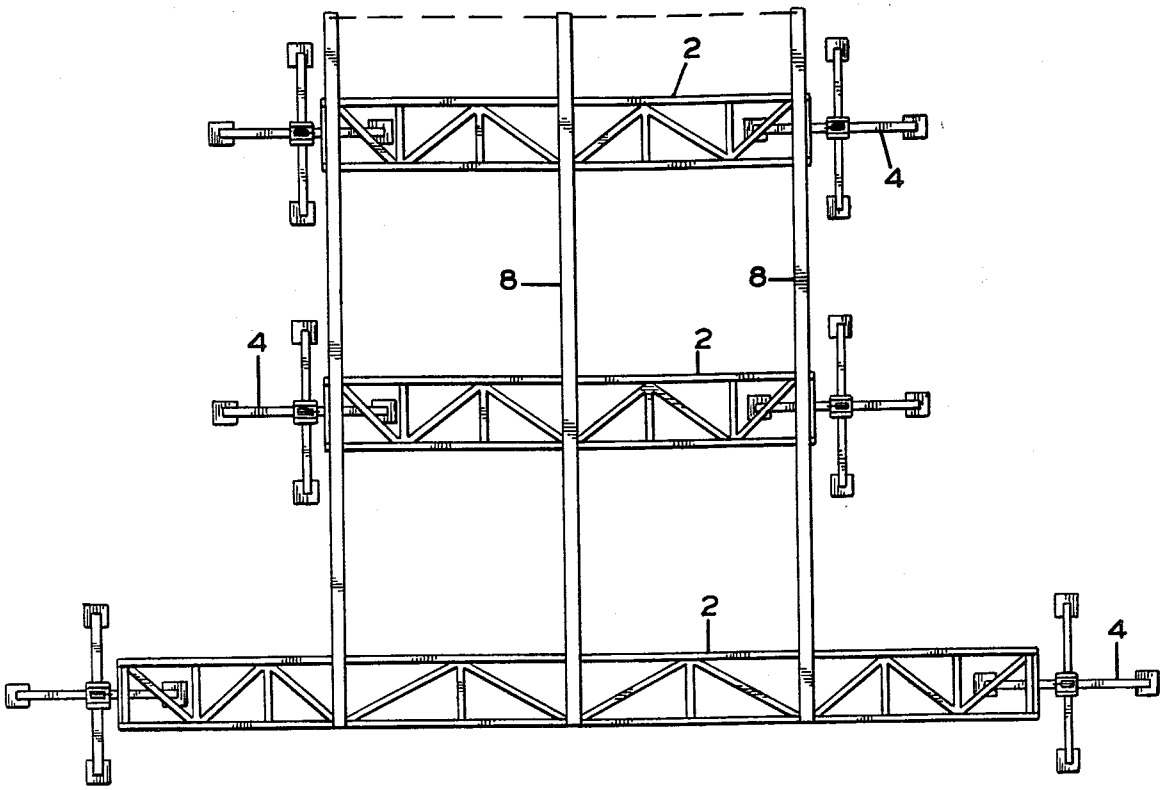
FIG. 1 is a top view of the stage.
Figure 2:
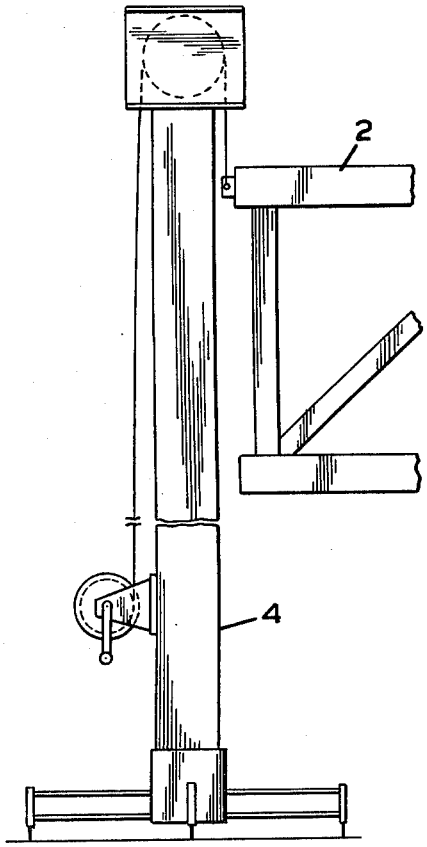
FIG. 2 is a side view of a vertical column and truss.

In FIG. 2, there is shown the means for raising the truss from the floor to its operative position. The truss is composed of a plurality of sections which are bolted together. Each section less lights is capable of being lifted by two individuals because of its configuration and the fact that it is made of aluminum. The individual sections are pinned together to form the overall truss length. The truss is assembled between its two vertical columns. Each vertical column has a winch on the side of the column opposite from that adjacent the truss. A cable goes up to the top of the vertical column, around a pulley, and down the far side of the vertical column to fasten to the end of the truss. The truss is assembled on the floor and then it is winched up to its operative position at the top of the vertical column. An angle plate 6, as shown in FIG. 3, is then bolted to the vertical column and the end of the truss is permitted to rest on that so the truss is not held in position by the winch, but is actually held on an angle plate bolted to the vertical column.

A plurality of I-beams 8 then rest upon the vertical trusses and span the gap between two adjacent trusses. The I-beams may be either single I-beams extending from one truss to the next truss or they could be sections of I-beams bolted together so that one long I-beam extends from the front truss all the way to the rear truss. Positioned below the center and rear trusses is the stage area which will be described later. In actual practice, the I-beams are attached to the truss tops while the trusses are still on the floor. The trusses and I-beams can then be raised to head height and crews can do all further cabling, curtaining, lighting, and scenery attachments without ladders and scaffolds.

Figure 3:
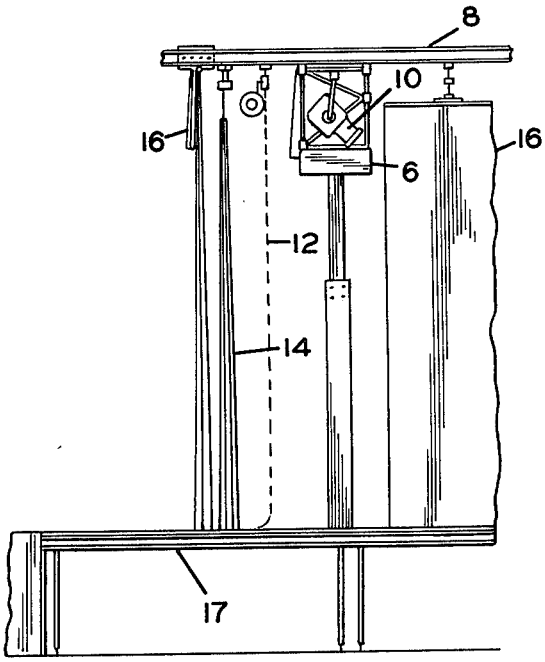
FIG. 3 is a side view of the complete stage.

Now referring to FIG. 3, there is shown the truss 2 supported on the vertical column 4 and held in place by the angle plate 6. It will be noted that within the perimeter of the cross section of the truss 2 there is located lighting means 10. All three trusses in use will have lighting means so that the front portion of the stage, the middle portion of the stage, and even the rear portion of the stage can be illuminated. As shown in FIG. 3, it can be seen that the I-beams can support a motion picture screen structure 12 which is shown in its down position, or a sliding curtain 14 or a fixed curtain 16, all of which are shown fastened to the I-beam structures. The curtain structures are conventional in the art and the fixed curtain would simply be fastened to a pipe which is bolted to the I-beams. The movable curtain would be movable in a conventional track structure also bolted to the I-beam. The screen is a conventional motion picture screen which has the housing for the screen fastened to the I-beam. Side curtains and rear curtains would also be fastened to the I-beams so that the stage would be fully enclosed with curtains and actually could have a plurality of curtains that could open from the front to the rear of the stage area. The curtain structures are all basically conventional in the art with the invention herein residing in the support structure composed of the vertical columns, the trusses and I-beams which provide the necessary supports upon which to fasten the conventional curtains, motion picture screens, or stage lighting. Scenic elements and different additional lighting can also be attached to the I-beam/truss structure.

As shown in FIG. 3, there is provided a plurality of collapsible table-like structures 17 which are positioned primarily under the center and rear trusses to form the stage area or stage platform which is raised above the flooring upon which the vertical supports rest. The collapsible stage structures are conventional in the art and their particular structure forms no portion of the invention herein. However, their particular utilization is believed to be especially advantageous with the stage support structure above described.

Figure 4:
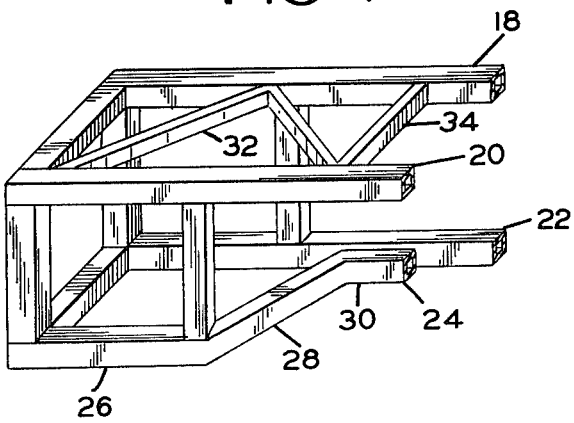
FIG. 4 a perspective view of a part of a truss structure.

Of particular uniqueness to the invention herein is the structure of the truss and this is shown in FIG. 4. The truss is formed from a plurality of chords and webs to define a rectangular type structure. The truss is approximately two feet square and has two upper chords 18 and 20. There is a lower chord 22 and these three chords 18, 20, and 22 are parallel to each other, are straight, and extend the full length of the truss. The second lower chord 24 is unique in structure. It is continuous, but it is positioned alternately in its normal corner position and in a position elevated therefrom. As shown in FIG. 4, the section of the lower chord 24 which is designated element 26 is in its normal corner position so that the chords 18, 20, 22, and 24 at that point actually form a rectangular configuration (See FIG. 3). However, as the chord 24 extends along the truss, it bends upward at section 28 until it exists in the area of element 30 and is now positioned above its normal corner position. In all cases, elements 26, 28, and 30 are in the same plane containing the chord 18. As shown in FIG. 3, element 30 which is the elevated portion of chord 24 is shown in its maximum elevated position and it can be seen that it is in the plane of chord 18, but it is elevated substantially above the lower right hand corner position of the rectangular truss structure. Also, in FIG. 3, it can be seen why it is necessary that the chord 24 extend up above its corner position. This permits lighting mounted within the truss to shine out without having the light path interrupted by chord 24. Consequently, the chord 24 is in its normal chord position where the truss will rest upon the angle plate 16, but in the regions where lighting fixtures will be provided, the chord 24 extends to its elevated position to free the corner of the truss of the chord structure so that light may be projected out of the corner of the truss to illuminate the stage. As can well be seen from FIG. 3, the outside structure of the light fixture is totally enclosed within the perimeter of the truss. Consequently, the truss members, when they are unbolted, can have the wiring for the lights disconnected at the truss joints and the trusses transported with the light fixtures still retained in position. Then when the stage is reassembled, the truss members and electrical wiring are simply fastened together and there is no need to remount the light structures within the truss. This provides a simplification of both the assembly of the stage and the assembly of the lighting which is necessary for proper illumination of the stage. Naturally, the trusses must be provided with appropriate web members, for example, elements 32 and 34 and many other web members which provide the truss with the necessary support for the four chord members and the necessary reinforcements for the truss so that it can span a length of up to almost 60 feet.

What is claimed is:

1. A traveling stage for positioning on a flooring comprising:

(a) three spaced apart main trusses positioned in a parallel relationship to each other and the flooring on which the stage is positioned, (b) vertical columns, at each end of each truss, resting on the flooring on which the stage is positioned, each column being perpendicular to the flooring and the truss it supports, (c) means raising the truss from the flooring at the base of the vertical column to the top of the vertical column and holding the truss in that position, (d) a plurality of I-beams spanning the distance between the trusses and fastened to the trusses, (e) lighting means carried within the trusses and curtain support means with curtains carried on the I-beams, and (f) a plurality of collapsible table-like structures being positioned on the flooring under at least one of the trusses to form a stage area raised above the flooring.

2. The traveling stage of claim 1 wherein a winch raises the truss from the base to the top of a vertical column.

3. The traveling stage of claim 1 wherein the trusses are generally rectangular in cross section and the stage lighting means is positioned on the truss with the lighting means having its exterior structure totally within the perimeter of the truss cross section.

4. The traveling stage of claim 3 wherein the truss is composed of two upper chords and one lower chord which are straight and parallel to each other, a second lower elevated chord which is continuous, but positioned alternatively in its corner position and a position elevated therefrom, and, appropriate web members to support the chords and reinforce the truss assembly.

5. The traveling stage of claim 4 wherein the lighting means directs light out of the lower corner of the truss when the elevated chord is in its elevated position.

* * * * *